US011608595B2

(12) United States Patent
Skawski

(10) Patent No.: US 11,608,595 B2
(45) Date of Patent: Mar. 21, 2023

(54) THROUGH-AIR APPARATUS WITH ADJUSTABLE DECKLE

(71) Applicant: Valmet, Inc., Biddeford, ME (US)

(72) Inventor: Jan Skawski, Portland, ME (US)

(73) Assignee: Valmet, Inc., Biddeford, ME (US)

( * ) Notice: Subject to any disclaimer, the term of this patent is extended or adjusted under 35 U.S.C. 154(b) by 268 days.

(21) Appl. No.: 17/069,950

(22) Filed: Oct. 14, 2020

(65) Prior Publication Data

US 2022/0112661 A1 Apr. 14, 2022

(51) Int. Cl.
*D21F 5/18* (2006.01)
*D21F 11/14* (2006.01)

(52) U.S. Cl.
CPC ..... *D21F 5/182* (2013.01); *D21F 11/145* (2013.01)

(58) Field of Classification Search
CPC ..... D21F 5/143; D21F 5/182; D21F 5/184; D21F 11/145; D21F 1/56; D21F 1/58; F26B 3/06
See application file for complete search history.

(56) References Cited

U.S. PATENT DOCUMENTS 3,246,401 A * 4/1966 Walser ..... D21F 5/02 34/115
3,589,033 A * 6/1971 Bryand ..... F26B 13/16 428/116
5,232,141 A 8/1993 Mittmeyer et al.
2002/0134882 A1 9/2002 Lind
2006/0021249 A1 2/2006 Hagen et al.
2019/0024313 A1 1/2019 Parker et al.

* cited by examiner

*Primary Examiner* — Eric Hug
(74) *Attorney, Agent, or Firm* — Pierce Atwood LLP; Kevin M. Farrell; Shannon Vittengl

(57) ABSTRACT

A through-air apparatus for drying or bonding paper or non-woven products is provided. The apparatus includes a through air roll configured to rotate about a first axis, where the roll has a cylindrical surface having a plurality of openings configured for the flow of air there through. The apparatus also includes an air distribution tube positioned within the through air roll. The air distribution tube has a cylindrical surface, a first end, and a second end, and the cylindrical surface of the air distribution tube has a plurality of openings configured for the flow of air there through. The apparatus further includes a first adjustable deckle associated with the air distribution tube configured to alter the flow of air through the air distribution tube. The first adjustable deckle includes a first floating plate configured to selectively cover a first portion of the plurality of openings in the air distribution tube, and a first deckle wall, wherein the first deckle wall is movable independent of the first floating plate. A method of assembling a through-air apparatus for drying or bonding paper or non-woven products is also provided.

20 Claims, 11 Drawing Sheets

THROUGH-AIR APPARATUS WITH ADJUSTABLE DECKLE

FIELD OF THE INVENTION

The invention relates, in part, to a through-air apparatus for manufacturing products, and methods of use, which include an adjustable deckle.

BACKGROUND

"Through air technology" is a term used to describe systems and methods enabling the flow of air through a paper or nonwoven web for the purpose of drying or bonding fibers or filaments. Examples include the drying of nonwoven products (e.g., tea bags and specialty papers); drying and curing of fiberglass mat, filter paper, and resin-treated nonwovens; thermobonding and drying of spunbond nonwovens; drying hydroentangled webs; thermobonding geotextiles with or without bicomponent fibers; drying and curing interlining grades; and thermobonding absorbent cores with fusible binder fibers. The drying of tissue paper is also another application of through air technology.

Systems and methods related to through-air drying are commonly referred to through the use of the "TAD" acronym. Systems and methods related to through-air bonding are commonly referred to through the use of the "TAB" acronym.

A through-air apparatus generally includes a fan/blower and a rigid air-permeable cylindrical shell (i.e. roll) configured to rotate about its central axis. The web is partially wrapped around the cylindrical shell, and as the web travels around the rotating shell, air flows through the wall of the cylindrical shell to treat the web. The cylindrical shell wall typically has a plurality of openings to permit the passage of air.

SUMMARY OF THE INVENTION

In a first aspect, a through-air apparatus for drying or bonding paper or non-woven products is provided. The apparatus includes a through air roll configured to rotate about a first axis, where the roll has a cylindrical surface, the cylindrical surface having a plurality of openings configured for the flow of air there through. The apparatus also includes an air distribution tube positioned within the through air roll, the air distribution tube having a cylindrical surface, a first end, and a second end, where the cylindrical surface of the air distribution tube has a plurality of openings configured for the flow of air there through. The apparatus also includes a first adjustable deckle associated with the air distribution tube, the adjustable deckle configured to alter the flow of air through the air distribution tube. The first adjustable deckle includes a first floating plate configured to selectively cover a first portion of the plurality of openings in the air distribution tube, and a first deckle wall, where the first deckle wall is movable independent of the first floating plate.

In another aspect, a method of assembling a through-air apparatus for drying or bonding paper or non-woven products is provided. The method includes providing a through air roll configured to rotate about a first axis, where the roll has a cylindrical surface having a plurality of openings configured for the flow of air there through. The method also includes providing an air distribution tube positioned within the through air roll, the air distribution tube having a first end, and a second end, and a cylindrical surface having a plurality of openings configured for the flow of air there through. The method also recites moving a first floating plate of a first adjustable deckle relative to the air distribution tube to alter the flow of air through the air distribution tube, where the first floating plate is configured to selectively cover a first portion of the plurality of openings in the air distribution tube, and where movement of the first floating plate is initiated by movement of a first deckle wall of a first adjustable deckle, and where the first deckle wall is movable independent of the first floating plate.

DETAILED DESCRIPTION

The present disclosure is directed to a through-air apparatus configured to manufacture paper or non-woven products. One of ordinary skill in the art would recognize that the through-air apparatus may be configured as a through-air dryer (TAD) and/or a through-air bonder (TAB), depending on the context in which the apparatus is used. One of ordinary skill in the art will also recognize that the through-air apparatus may be used to make paper or non-woven products that are rolled in their finished end product form. It should also be recognized that the product may not be rolled and/or may be cut into a finished end product. Furthermore, one of ordinary skill in the art will also recognize that the through-air apparatus may be configured to make paper or non-woven products, including, but not limited to various films, fabric, or web type material, and the apparatus may be used for various processes that may include mass transfer, heat transfer, material displacement, web handling, and quality monitoring, including, but not limited to drying, thermal bonding, sheet transfer, water extraction, web tensioning, and porosity measurement.

The web (i.e. product) is typically in a sheet-form and it is partially wrapped around a cylindrical shell (i.e. through-air roll). In one embodiment, the web is wrapped about a portion of the roll ranging from 5° to 360°, and typically between 180°-300° around the roll. The cylindrical wall of the through-air roll typically has a plurality of openings configured for air to pass through. The apparatus includes a fan/blower to circulate the air across the product, and the through-air roll is typically positioned within a hood to optimize the air flow characteristics. As the product travels around the rotating shell, the fan/blower circulates air through the wall of the cylindrical shell to treat the product. In certain embodiments, a heater may be provided to increase the temperature of the air that circulates through the through-air roll.

Figure 1:
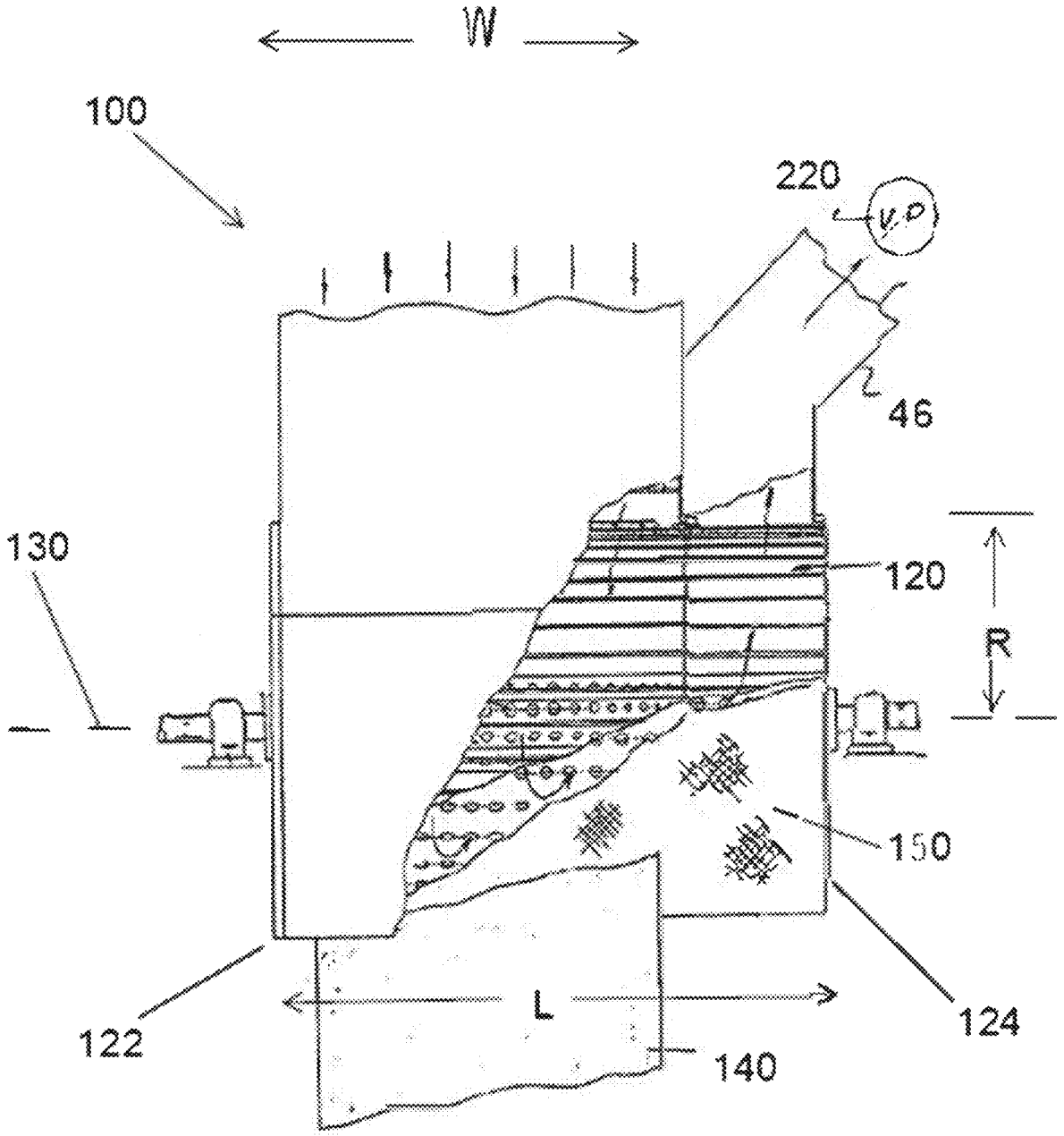
FIG. 1 is a side view of a through-air apparatus according to one embodiment.

One exemplary through-air apparatus 100 is illustrated in FIG. 1. As shown, the through-air apparatus 100 includes a though-air roll 120 that is configured to rotate about a first axis 130. The through-air roll 120 has a first end 122 and a second end 124. One end of the roll may be connected to a motor and drive assembly (i.e. drive side) and the opposite end may be known as the tend side. A through-air apparatus 100 is typically a very large machine. For example, the through-air roll 120 may have a length L between 1 foot-30 feet, and a radius R between 1 foot-10 feet.

The cylindrical wall of the roll 120 may be formed of an open rigid structure to permit the flow of air therethrough. In one embodiment, the through-air roll 120 may be a HONEYCOMB ROLL® obtained from Valmet, Inc. As shown in FIG. 1, the apparatus may include an exhaust opening 46 and a vacuum source 220 so that air flows through the cylindrical wall of the roll 120 and out through the exhaust opening 46.

As shown in FIG. 1, the apparatus 100 may further include a sleeve 150 extending around the through-air roll 120 to provide support for the web 140 (i.e. product) having a width W. The sleeve 150 may be made of a flexible material and it may be in sheet form. As shown in FIG. 1, the sleeve 150 may substantially cover the through-air roll 120. The sleeve 150 may be made of wire and it may be secured to the through-air roll 120 and configured to rotate about the first axis 130 with the through-air roll 120. In another embodiment, traveling wire and/or fabric may be employed instead of, or in addition to, the wire sleeve 150.

Figure 2:
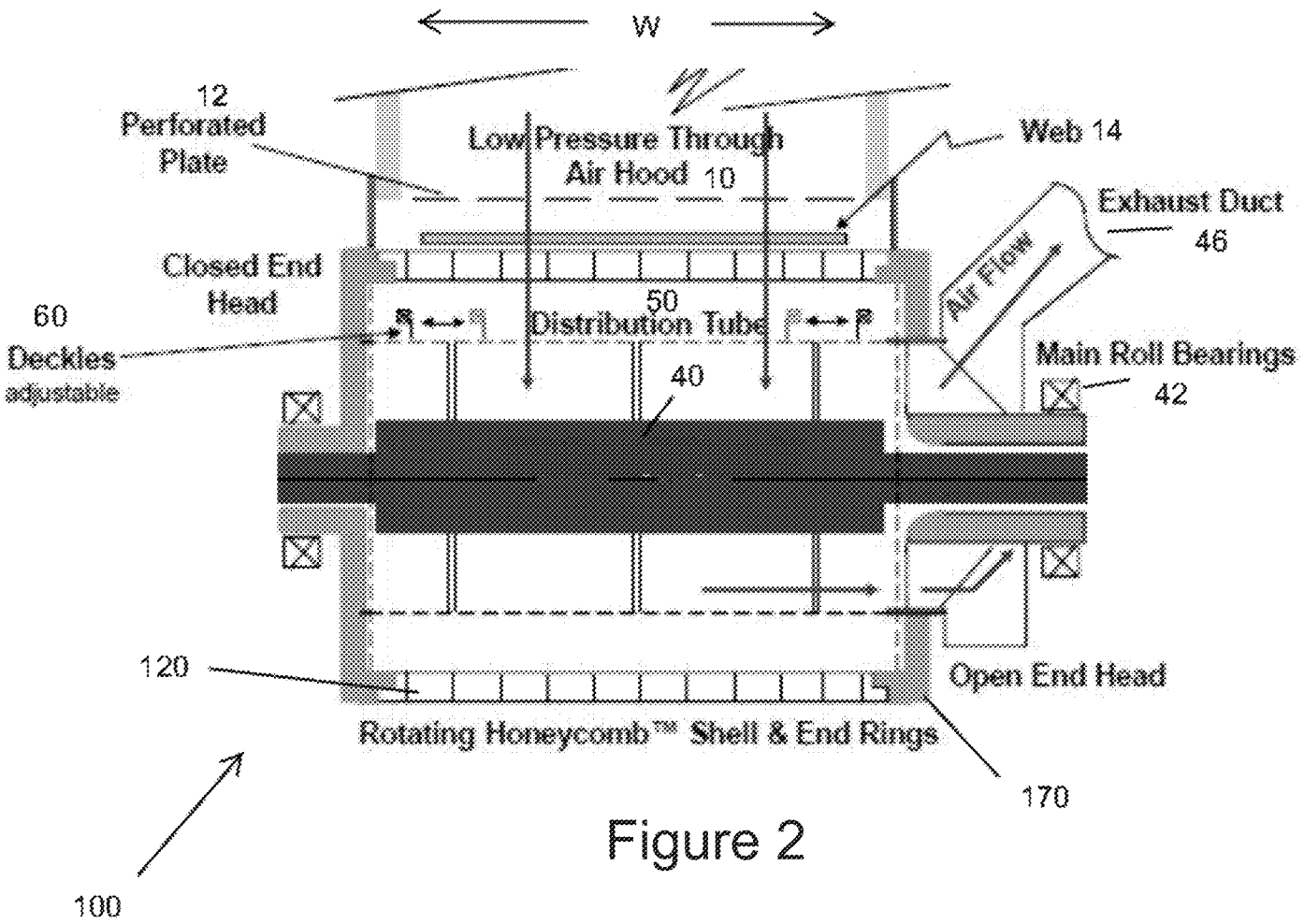
FIG. 2 is a schematic cross-sectional view of the inside of a conventional through-air apparatus.

Turning now to FIG. 2, the internal structure of the through-air apparatus 100 is disclosed in more detail. Inside the through-air roll 120 is an air distribution tube 50 which has a cylindrical surface with a plurality of openings configured for the flow of air there through. The size, shape and configuration of the plurality of openings in the air distribution tube may be selected to provide optimal air flow characteristics. As shown, air flows into the through-air roll 120, and through the air distribution tube 50. An exhaust opening 46 may be provided at one end, or at both ends of the apparatus. Once inside the air distribution tube 50, the air may flow along the first axis 130 and out through the exhaust opening 46. One of ordinary skill in the art will recognize that the web product 14 is partially wrapped around the through-air roll 120 so that the air flow dries, cures, bonds, heats, and/or otherwise processes the web product 14 while on the through-air apparatus 100. As shown, the apparatus 100 may be enclosed within a hood 10 to optimize the air flow characteristics.

The width W of the web product 14 may vary based upon the particular application. Deckles 60 may be provided inside of the apparatus 100 at each end of the air distribution tube 50 and the position of these deckles 60 may be altered based upon the width W of the web product. These deckles 60 are substantially annular shaped rings (i.e. walls) that can slide between a minimum position and a maximum position to alter the air flow characteristics. These deckles 60 may slide along the air distribution tube and they extend radially outwardly toward the through-air roll 120. An actuator, such as a deckle drive assembly, may be provided on the apparatus to move the deckles.

The inventor recognized problems associated with a conventional through-air apparatus having the above-described deckle configuration. In particular, the deckle in FIG. 2 is just an axial barrier. Depending on the particular position of the deckle, the air flow pattern may not be uniform across the width of the web 14 as desired.

The purpose of the air distribution tube is to control the air flow such that the correct quantity of air flows through the web 14 in all areas (i.e. uniform air flow). Failure to adequately control the air flow may result in non-uniform drying of the web 14. One of ordinary skill in the art will appreciate that one or more of the following design considerations will dictate the design of the air distribution tube: paper permeability range encompassing intended product scope, total air flow requirement ($m^3/s$), roll diameter, air distribution tube diameter, product width range on the through-air apparatus, deckles adjustment range, and local internal velocities. Furthermore, the air distribution tube may be designed based upon databases of actual machines, computational fluid dynamics, and/or in-house computer modeling and/or laboratory scale models of the apparatus.

Figures 3A, 3B:
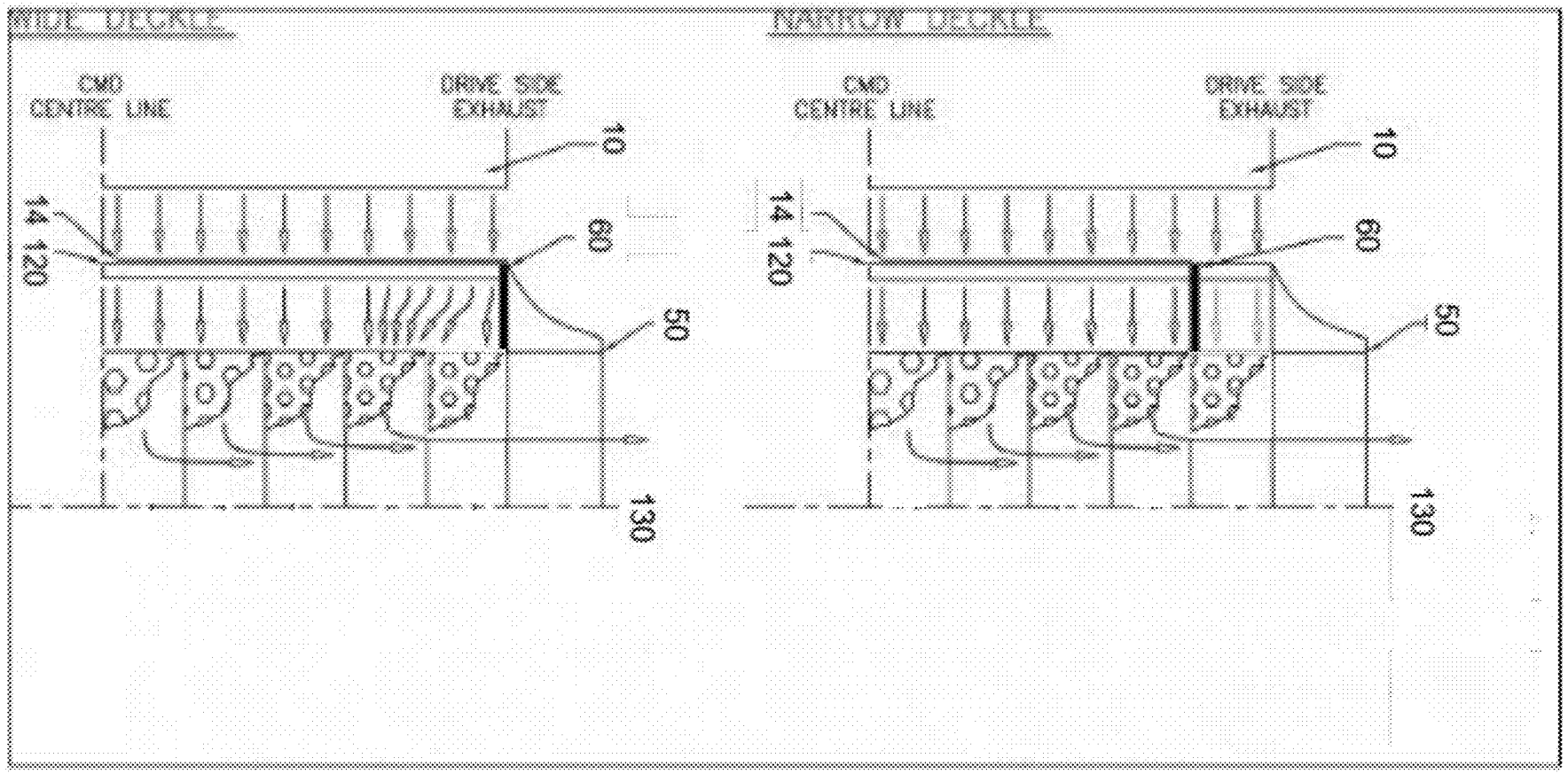
FIG. 3A is a schematic cross-sectional view of a conventional through-air apparatus illustrating the air flow pattern with a deckle in the maximum position (i.e. wide deckle)
FIG. 3B is a schematic cross-sectional view of a conventional through-air apparatus illustrating the air flow pattern with a deckle in the minimum position (i.e. narrow deckle)

FIGS. 3A and 3B illustrate conventional deckles 60 in greater detail. These figures illustrates one half of the apparatus 100, thus only one end of the air distribution tube 50 is shown. FIG. 3A shows one deckle 60 in a maximum position (i.e. wide deckle position) and FIG. 3B shows the deckle 60 in a minimum position (i.e. narrow deckle position). The size, shape and configuration of the plurality of openings in the air distribution tube 50 may be selected to provide optimal air flow characteristics. As shown in FIGS. 3A and 3B, the air distribution tube 50 may include a plurality of zones and the size, shape, and/or configuration of the plurality of openings in each zone may be varied. As shown in FIG. 3A, in a maximum position, the deckle 60 is located at a distal end of the air distribution tube 50. As shown in FIG. 3B, in a minimum position, the deckle 60 is moved inwardly to a proximal location on the air distribution tube 50.

FIGS. 3A and 3B also illustrates the air flow pattern through the apparatus 100. As shown, the air flows through the web 14 and the through-air roll 120. As shown in FIG. 3B, when the deckle 60 is in the minimum position, the air flow through the air distribution tube may be substantially uniform. However, as shown in FIG. 3A, when the deckle is moved to the maximum position, the air flow may not be uniform across the length of the air distribution tube 50. This is generally not desirable. As shown, the air may flow non-uniformly through each zone of the air distribution tube 50. After the air passes through the air distribution tube 50, an exhaust line (not shown) may pull the air toward the right in a direction substantially parallel to the first axis 130. The arrows representing air flow in FIG. 3A illustrate the problem of non-uniform airflow that may occur with a conventional deckle.

The inventor recognized that there are problems associated with the conventional deckle designs. As shown in FIG. 3A, with the deckle 60 in its maximum position, the air flow resistance is too high at one end of the air distribution tube. These zones of the air distribution tube 50, which are located at each end of the air distribution tube, are difficult to design for all machine scenarios. The air velocity in these areas may be too high or too low relative to the air velocities in the other areas.

Figure 4:
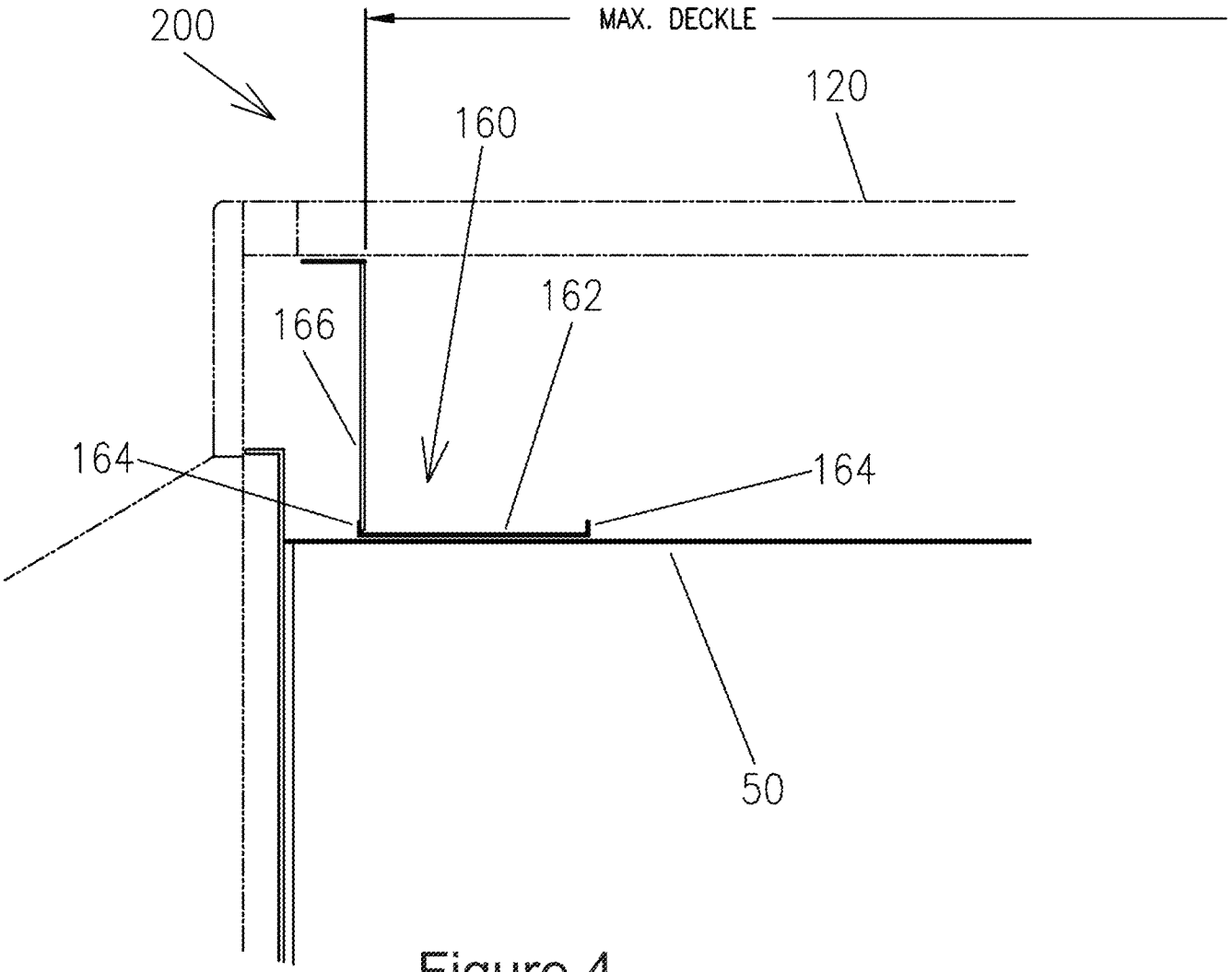
FIG. 4 illustrates a schematic cross-sectional view of a through-air apparatus with an adjustable deckle in a maximum position according to one embodiment.

The inventor developed a new deckle configuration that solves some of the problems associated with conventional deckles in a through-air apparatus. FIG. 4 illustrates a schematic cross-sectional view of a through-air apparatus 200 with a first adjustable deckle 160 which is configured to alter the flow of air through the air distribution tube 50. In FIG. 4, the first adjustable deckle 160 is shown in a maximum position. As shown, this first adjustable deckle 160 includes a first floating plate 162 which is configured to selectively cover a first portion of the plurality of openings in the air distribution tube 50. As set forth in more detail below, the floating plate 162 may be selectively moved to act as a sliding plate to provide more uniform air flow across the web product for a range of web widths. As shown, the first adjustable deckle 160 also includes a first deckle wall 166, wherein the first deckle wall 166 is movable independent of the first floating plate 162.

It should be recognized that FIG. 4 only illustrates a portion of the through-air apparatus 200, and only one end of the air distribution tube 50. As set forth in greater detail below, the apparatus may further include a second adjustable deckle 260 (see FIGS. 6 and 8) associated with the air distribution tube 50. The second adjustable deckle 260 may look substantially like the first adjustable deckle 160 and may include a second floating plate 262 which is configured to selectively cover a second portion of the plurality of openings in the air distribution tube 50. The second adjustable deckle 260 may also include a second deckle wall 266, wherein the second deckle wall 266 is movable independent of the second floating plate 262. In one illustrative embodiment, the first adjustable deckle 160 is positioned at the first end of the air distribution tube, as shown in FIG. 4. It should be appreciated that in one embodiment shown in FIG. 6, the second adjustable deckle 260 is positioned at the second end of the air distribution tube 50.

Figure 6:
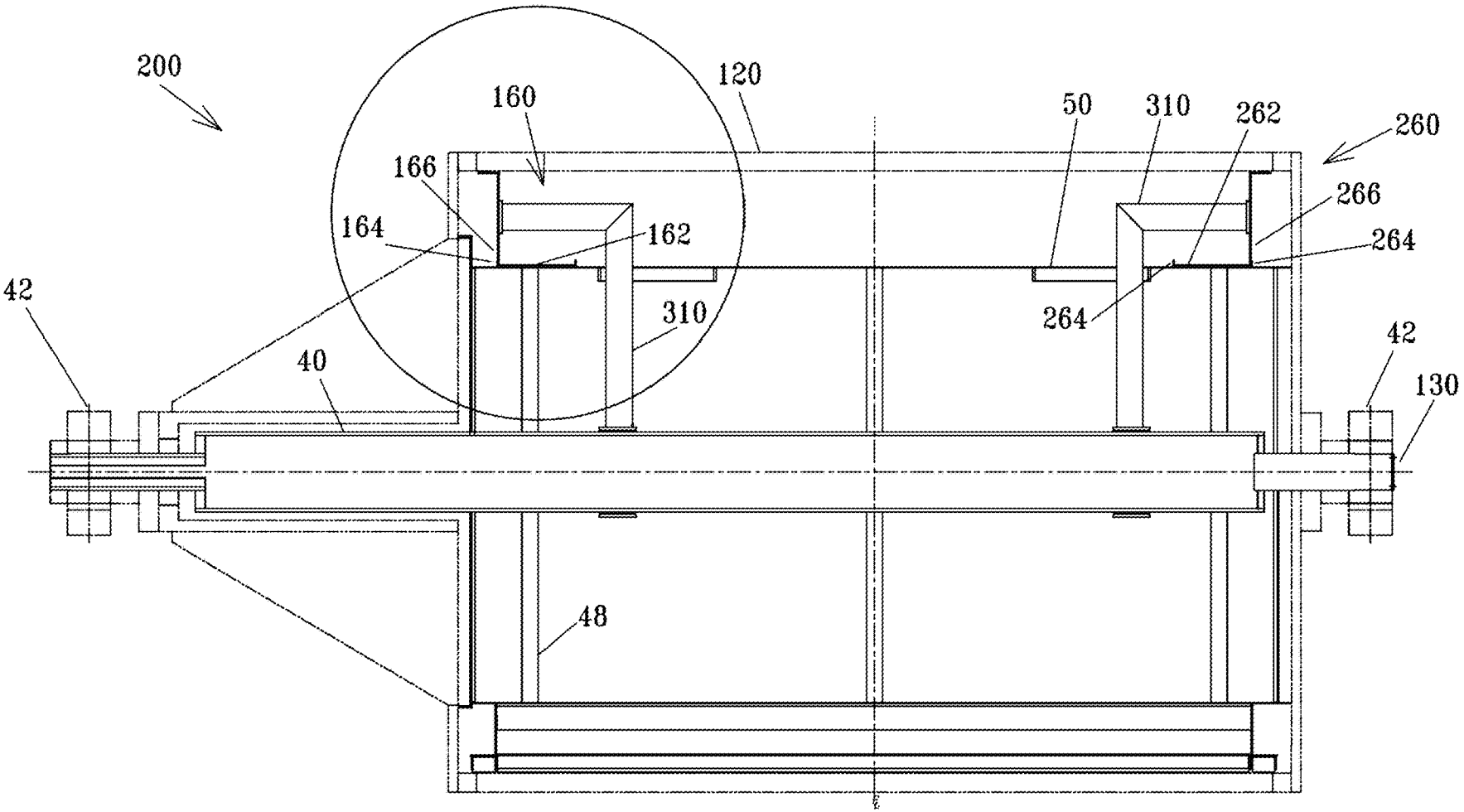
FIG. 6 is a cross-sectional view of a through-air apparatus with an adjustable deckle in a maximum width position according to one embodiment.

As shown in FIG. 4, the first floating plate 162 may include a catch 164 positioned on each end of the first floating plate 162, where each catch 164 is configured to limit movement of the first deckle wall 166. As shown in FIG. 6, the second floating plate 262 may also include a catch 264 positioned on each end of the second floating plate 262, where each catch 264 is configured to limit movement of the second deckle wall 266. As set forth in more detail below, in one embodiment, the catch 164, 264 is also configured to contact the deckle wall 166, 266 so that movement of the deckle wall 166, 266 initiates movement of the corresponding floating plate 162, 262 and both the floating plate and its corresponding deckle wall are slidably movable together. In this respect, the deckle wall 166, 266 is selectively movable with the floating plate 162, 262.

Figure 5:
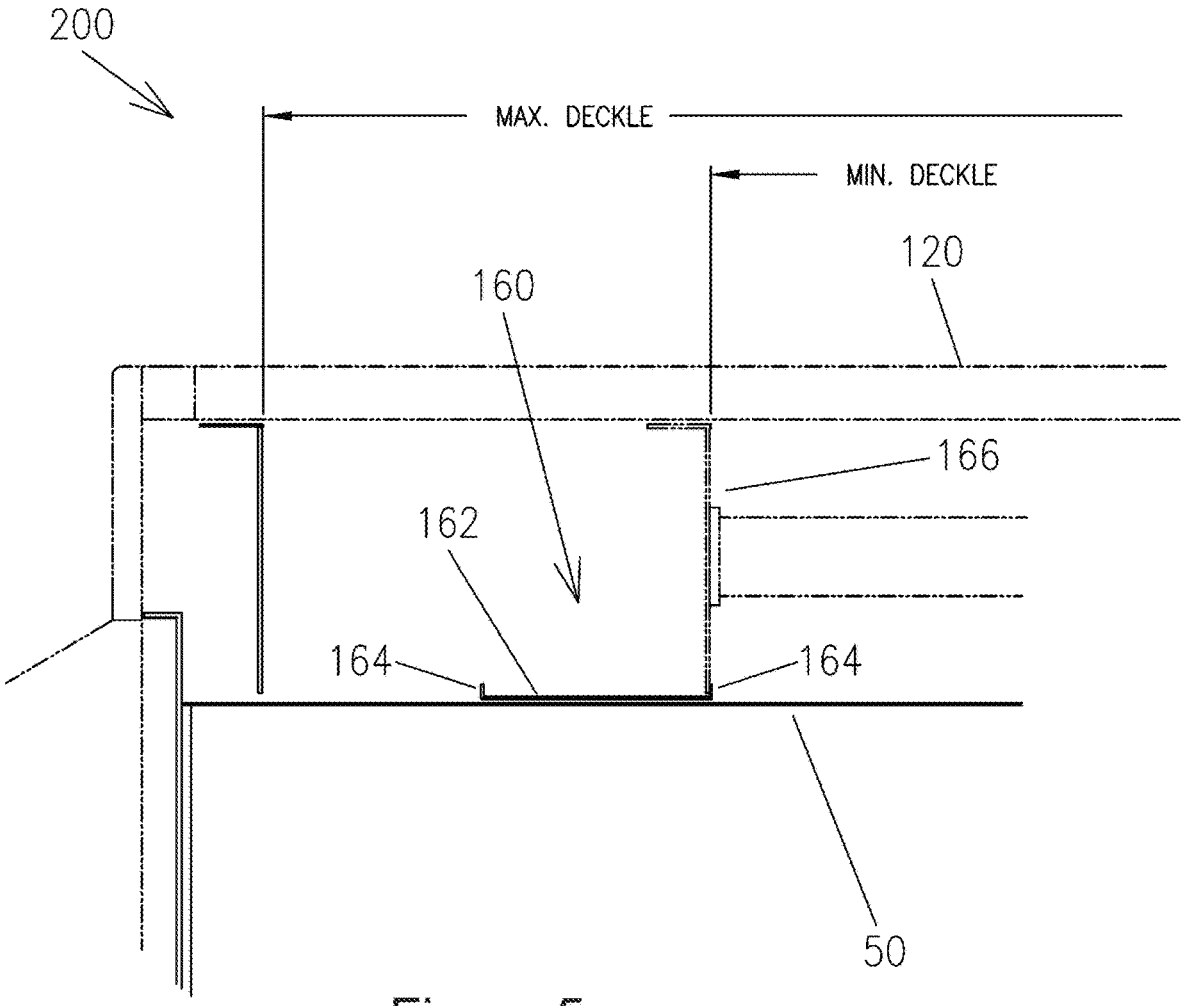
FIG. 5 illustrates a schematic cross-sectional view of a through-air apparatus with an adjustable deckle in a minimum position according to one embodiment.

FIG. 5 illustrates a schematic cross-sectional view of a through-air apparatus 200 with the first adjustable deckle 160 shown in phantom lines moved into a minimum deckle position. In other words, the first adjustable deckle 160 may be moveable between the maximum deckle position shown in FIG. 4 and the minimum deckle position shown in phantom lines in FIG. 5. The first and second adjustable deckles 160, 260 may both be movable between a minimum deckle position and a maximum deckle position. It is contemplated that the adjustable deckles 160, 260 may be moved into an intermediary position, so that the distance between the first deckle wall 166 and the second deckle wall 266 (see FIGS. 6 and 8) can be determined based upon the width of a product to be positioned on the apparatus.

Additional detail is provided below, but in one embodiment, the apparatus shown in FIG. 4 is configured so that movement of the first deckle wall 166 to the right minimizes the distance between the two deckles. As shown in FIG. 4, initially, the first deckle wall 166 may move independent of the first floating plate 162. In other words, the first floating plate 162 may remain stationary as the first deckle wall 166 moves inwardly along the floating plate 162. After the first deckle wall 166 moves a distance approximately equal to the width of the first floating plate 162, the first deckle wall 166 contacts the catch 164 on the right end of the first floating plate 162, and thus further movement of the first deckle wall 166 also causes the first floating plate 162 to slide with it. FIG. 5 illustrates the minimum deckle position in phantom lines. The width of the zone outside of the sheet width on the air distribution tube 50 may vary between approximately 2 inches to 60 inches wide. In one embodiment, the end zone of the air distribution tube may be approximately 2-25 inches wide. However, in this configuration, the effective width of the zone has essentially doubled to approximately 4-50 inches with the addition of the first floating plate 162. As discussed above, the end zone of the air distribution tube 50 plate may be configured to have a different size, shape, and/or configuration of the plurality of openings in comparison to other zones on the air distribution tube 50. The addition of the movable first and second floating plates 162, 262 enable one to effectively enlarge this zone, as desired, to provide a more uniform air flow across the web 14.

Figure 7:
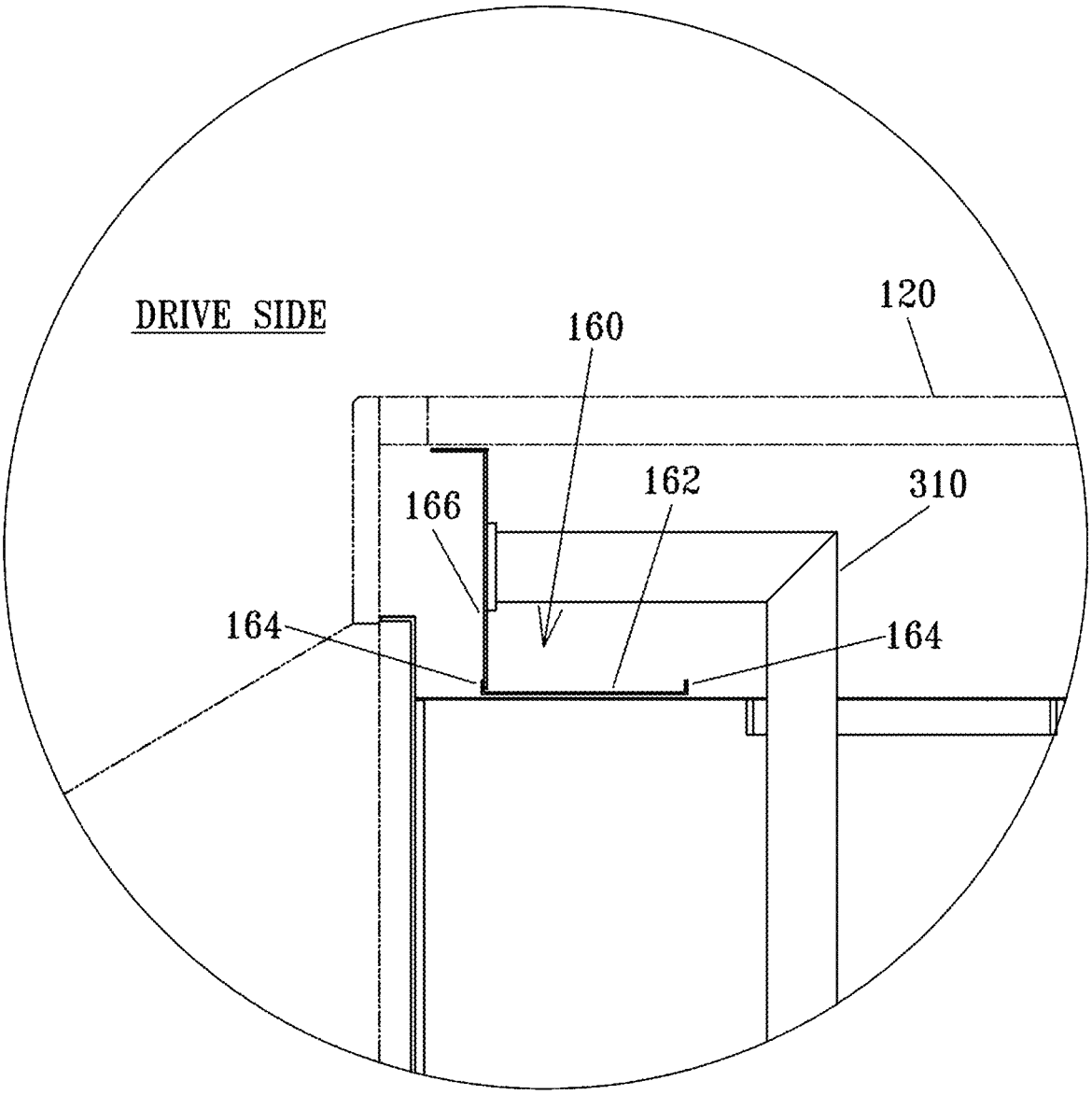
FIG. 7 is a detailed section view of the circled area shown in FIG. 6.
Figure 8:
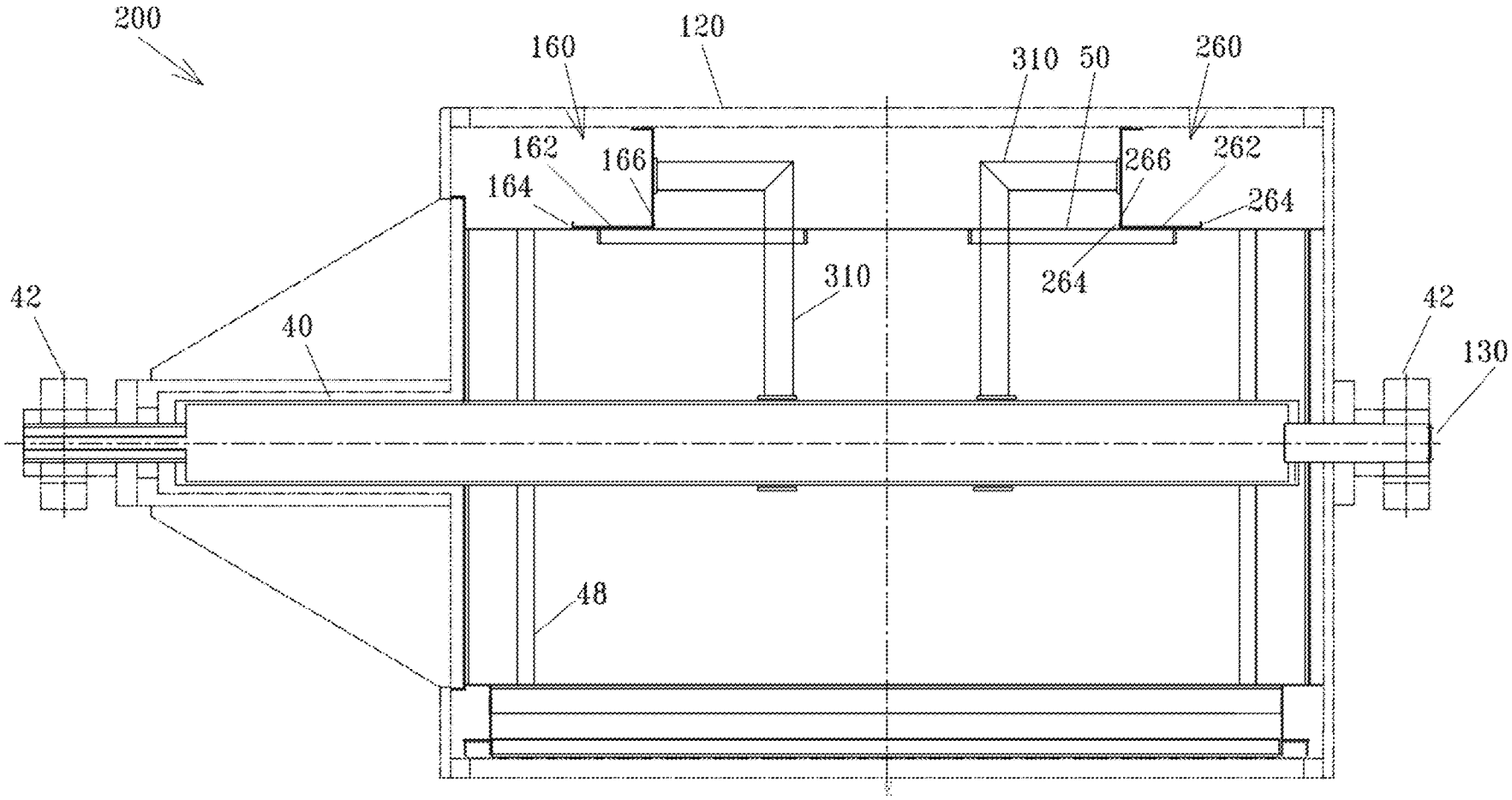
FIG. 8 is a cross-sectional view of a through-air apparatus with an adjustable deckle in a minimum width position according to one embodiment.
Figure 9:
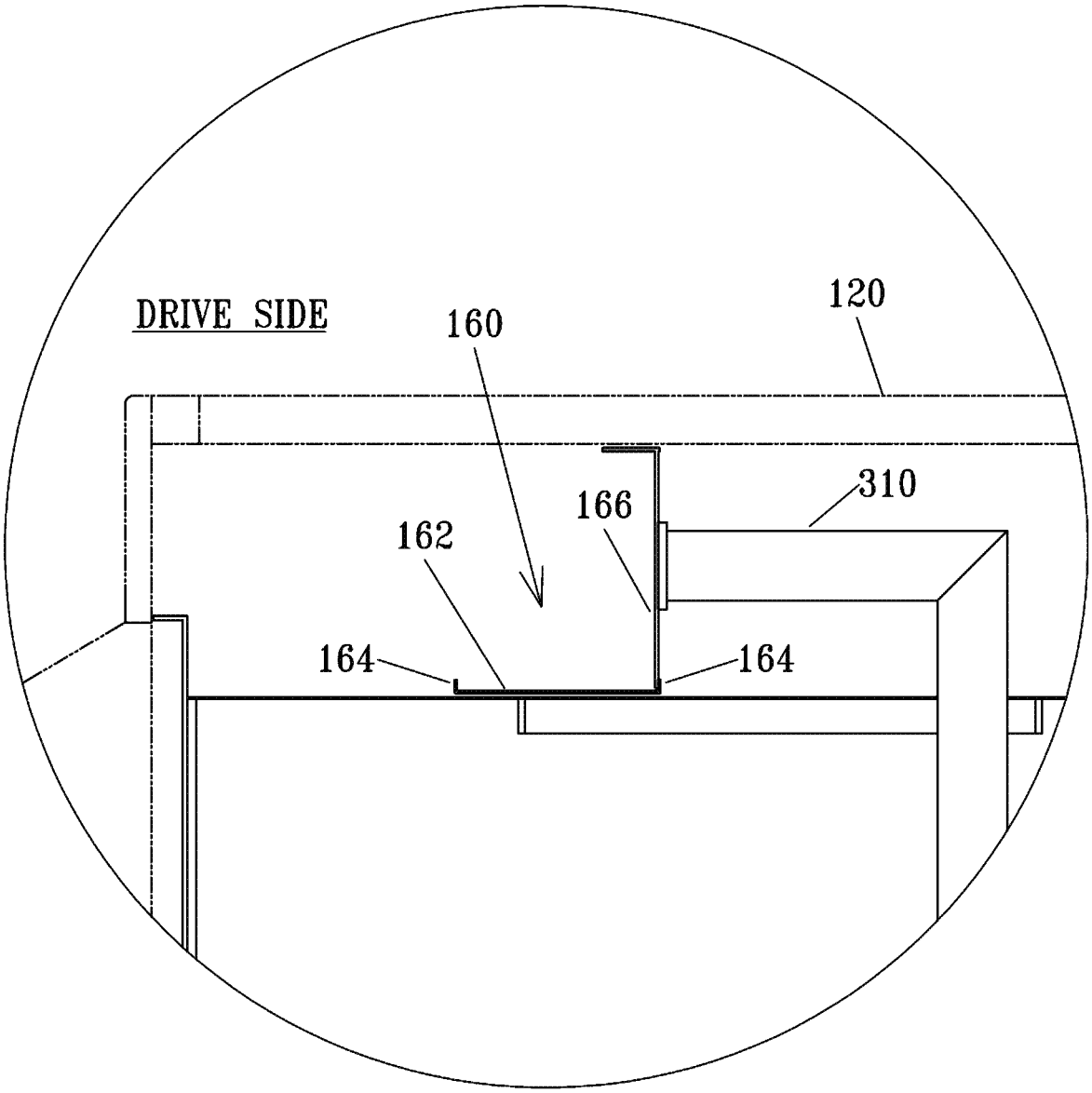
FIG. 9 is a detailed section view section of the apparatus shown in FIG. 8.

FIG. 6 illustrates another view of the through-air apparatus 200 which includes both the first adjustable deckle 160 and the second adjustable deckle 260. In FIG. 6, the first and second adjustable deckles 160, 260 are shown in their maximum position with the first and second floating plates 162, 262 positioned directly over the end zone located on the air distribution tube 50. FIG. 7 illustrates a close up detailed section view of the circled section in FIG. 6. In contrast, FIG. 8 illustrates the through-air apparatus 200 with the first and second adjustable deckles 160, 260 shown in their minimum position with the first and second floating plates 162, 262 moved inwardly so that the floating plates 162, 262 are spaced apart from (i.e. not positioned directly over) the end zone located on the air distribution tube 50. FIG. 9 illustrates a close up detailed section view of a portion of the apparatus in FIG. 8.

As shown in FIGS. 6-9, the through-air apparatus 200 may include a deckle carriage 310 which is configured to slide the first and second deckles walls 166, 266. As shown, the deckle carriage may include an L-shaped component which has one end that is movable with the first or second deckles wall 166, 266, and another end that is slidably coupled to the pipe 40 and is movable along the first axis 130. One of ordinary skill in the art will recognize that a conventional deckle carriage 310 may be used as the disclosure is not so limited.

The apparatus 200 may also include an actuator (such as a deckle drive assembly positioned at one end of the apparatus 200) configured to move the first adjustable deckle 160 from a first position (i.e. maximum position shown in FIG. 6) to a second position (i.e. such as the minimum position shown in FIG. 8). The actuator may also be configured to move the second adjustable deckle 260 from a first position to a second position. In one embodiment, the actuator is coupled to the deckle carriage 310 and is configured to move the first and second adjustable deckles 160, 260 together. Independent movement of each of the adjustable deckles is also contemplated as the disclosure is not so limited. The actuator may be configured to move the first and second plates 162, 262 in a direction substantially parallel to the first axis 130. As shown, each deckle wall 166, 266, is positioned between the two catches 164, 264. Thus, as the actuator initiates movement of the first and second deckle walls 166, 266, the first and second deckle walls 166, 266 contact with one of the catches 164, 264 which then may cause the first and second floating plates 162, 262 to move with the deckle wall. It should be appreciated that in this configuration, the sliding movement of the deckle wall 166, 266 may be limited by the horizontal distance between the two catches located on each plate 162, 262. For example, as set forth above, in one embodiment, the horizontal sliding movement of the deckle walls 166, 266 is approximately double the width of the first or second floating plate 162, 262.

As shown in FIG. 6, in one embodiment, the air distribution tube 50 is concentric with the through-air roll 120. In other words, both the air distribution tube 50 and the through-air roll 120 are centered along the first axis 130. As shown in FIG. 6, and as also outlined above with respect to FIG. 2, in one embodiment, a pipe 40 is positioned along the first axis 130 and the air distribution tube 50 is supported radially by the pipe 40, for example with pipe support 48 and main roll bearings 42. The above-described adjustable deckle is described for use with a stationary air distribution tube 50. It is also contemplated that the adjustable deckle can be used with a rotating air distribution tube as the disclosed is not so limited.

As discussed above, aspects of the present disclosure are directed to a through-air apparatus which enables uniform air flow for webs having a variety of widths. Thus, it should be recognized that the first and second floating plates may be designed to provide uniform air flow in both the minimum and maximum deckle position. Many of the figures in the application are cross-sectional views and thus the floating plates appear to be flat. However, it should be appreciated that in one embodiment, each floating plate 162, 262 is cylindrical shaped and is sized to extend around the outside diameter of the air distribution tube 50.

In one embodiment, the first floating plate 162 has a cylindrical surface with a plurality of openings therethrough, where the first floating plate 162 is configured to alter the flow of air through the air distribution tube 50. In another embodiment, the first floating plate 162 has a cylindrical solid surface, which is configured to reduce the flow of air through a first portion of the air distribution tube 50. In one embodiment, the first and second floating plates 162, 262 each have a cylindrical surface with a plurality of openings therethough, where the first and second floating plates 162, 262 are configured to alter the flow of air through the air distribution tube 50. In another embodiment, the first and second floating plates 162, 262 each have a cylindrical solid surface, where the first and second floating plates 162, 262 are configured to reduce the flow of air through a second portion of the air distribution tube 50.

In one embodiment, the first deckle wall 166 has an annular shape which extends outwardly from the air distribution tube 50 to the through-air roll 120. In one embodiment, the second deckle wall 266 also has an annular shape which extends outwardly from the air distribution tube 50 to the through-air roll 120. It should be appreciated that there should be at least a minimum spacing between the inside diameter of the through-air roll 120 and the outermost surface of the deckle walls 166, 266 to provide clearance when the through-air roll rotates about the first axis 130 during operation.

Furthermore, one of ordinary skill in the art would recognize that in one embodiment, the above-described adjustable deckle may be used on a through-air dryer, and in another embodiment, the above-described adjustable deckle may be used on a through-air bonder, as the disclosure is not so limited.

Figure 10:
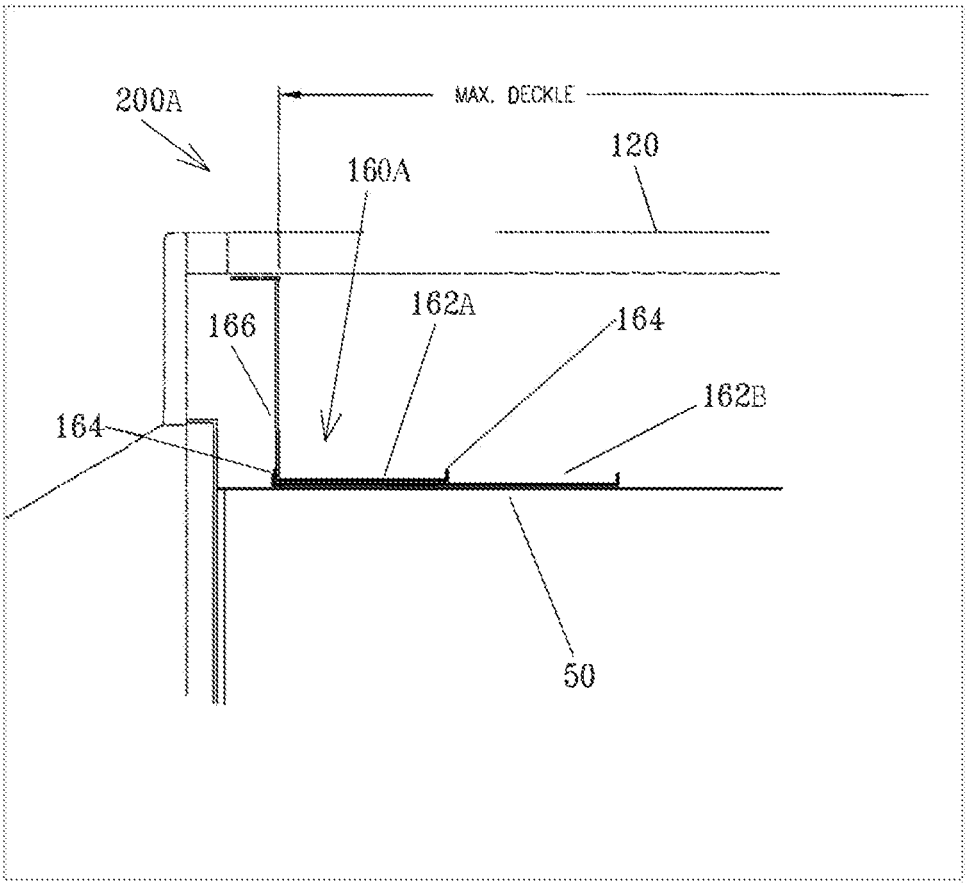
FIG. 10 illustrates a schematic cross-sectional view of a through-air apparatus with a multi-plate adjustable deckle in a maximum position.
Figure 11:
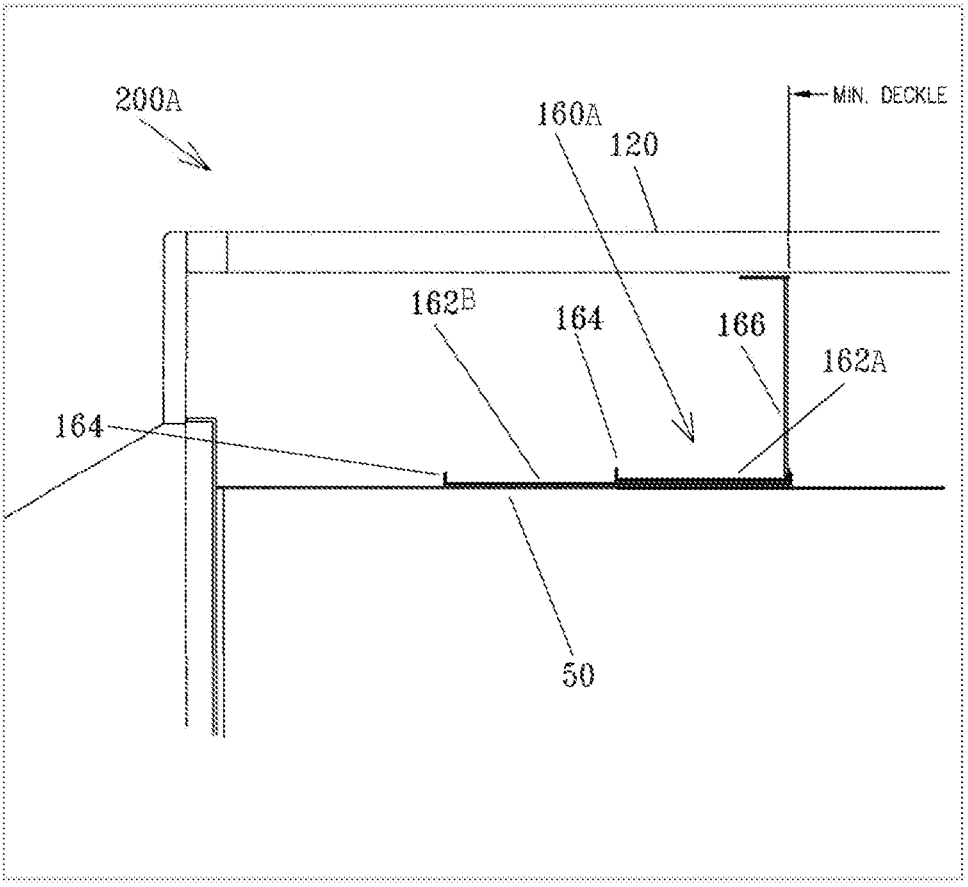
FIG. 11 illustrates a schematic cross-sectional view of the through-air apparatus shown in FIG. 10 with the multi-plate adjustable deckle in a minimum position.

FIGS. 10 and 11 illustrate a schematic cross-sectional view of another embodiment of a through-air apparatus 200A. Through-air apparatus 200A is similar to the above-described through-air apparatus 200 and thus has similar reference numbers. However, through-air apparatus 200A feature a multi-plate first adjustable deckle 160A which is configured to alter the flow of air through the air distribution tube 50. In FIG. 10, the multi-plate first adjustable deckle 160A is shown in a maximum position, whereas in FIG. 11, the multi-plate first adjustable deckle 160A is shown in a minimum position. As shown, this multi-plate first adjustable deckle 160A includes a first floating plate portion 162A, and a second floating plate portion 162B which are each movable and are configured to selectively cover a portion of the plurality of openings in the air distribution tube 50. As discussed above with respect to the first floating plate 160 shown in FIGS. 4-9, the first and second floating plate portions 162A, 162B may be selectively moved to act as a sliding end zone to provide more uniform air flow across the web product for a range of web widths. As shown, the multi-plate first adjustable deckle 160A also includes a first deckle wall 166, wherein the first deckle wall 166 is movable independent of the first and second floating plate portions 162A, 162B. Furthermore, the first and second floating plate portions 162A, 162B may each include the above-described catches 164 on one or both ends. One of ordinary skill in the art will appreciate that the through-air apparatus 200A shown in FIGS. 10-11 may operate substantially similar to the above-described through-air apparatus 200 shown in FIGS. 4-9, except that the multi-plate first adjustable deckle 160A may enable one to increase the total deckling width. The inventor contemplates that a multi-plate first adjustable deckle 106A may include two, three, four or more movable plate portions 162A, 162B, as the disclosure is not so limited. As one can see from FIGS. 10-11, these multiple plate portions 162A, 162B may be stacked on each other. Furthermore, although FIGS. 10-11 only illustrate a portion of the through-air apparatus 200A, it should be appreciated that a multi-plate second adjustable deckle may be provided on the opposite end of the apparatus 200A.

Aspects of the present disclosure are directed to methods of assembling a through-air apparatus for drying or bonding paper or non-woven products. The method includes providing a through air roll configured to rotate about a first axis, where the roll has a cylindrical surface having a plurality of openings configured for the flow of air there through. The method also includes providing an air distribution tube positioned within the through air roll, the air distribution tube having a first end, and a second end, and a cylindrical surface having a plurality of openings configured for the flow of air there through. The method also includes moving a first floating plate of a first adjustable deckle relative to the air distribution tube to alter the flow of air through the air distribution tube, where the first floating plate is configured to selectively cover a first portion of the plurality of openings in the air distribution tube, and where movement of the first floating plate is initiated by movement of a first deckle wall of a first adjustable deckle, where the first deckle wall is movable independent of the first floating plate.

In one embodiment, the method may further include moving a second floating plate of a second adjustable deckle relative to the air distribution tube to alter the flow of air through the air distribution tube, where the second floating plate is configured to selectively cover a second portion of the plurality of openings in the air distribution tube, and where movement of the second floating plate is initiated by movement of a second deckle wall of a second adjustable deckle, where the second deckle wall is movable independent of the second floating plate.

The method may further include where the first and second adjustable deckles are both moveable between a minimum deckle position and a maximum deckle position so that a distance between the first deckle wall and the second deckle wall can be positioned based upon the width of a product to be positioned on the apparatus.

Although several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto; the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. A through-air apparatus for drying or bonding paper or non-woven products, the apparatus comprising:

a through air roll configured to rotate about a first axis, wherein the roll has a cylindrical surface, the cylindrical surface having a plurality of openings configured for the flow of air there through;

an air distribution tube positioned within the through air roll, the air distribution tube having an outer surface, a first end, and a second end, the outer surface of the air distribution tube having a plurality of openings configured for the flow of air there through;

a first adjustable deckle associated with the air distribution tube, the adjustable deckle configured to alter the flow of air through the air distribution tube, the first adjustable deckle comprising:

a first floating plate configured to selectively cover a first portion of the outer surface of the air distribution tube; and a first deckle wall, wherein the first deckle wall is movable independent of the first floating plate, and wherein movement of the first floating plate is initiated by movement of the first deckle wall.

2. The through-air apparatus of claim 1, wherein the first floating plate is selectively movable with the first deckle wall.

3. The through-air apparatus of claim 1, wherein the first adjustable deckle is positioned at the first end of the air distribution tube.

4. The through-air apparatus of claim 3, further comprising:

a second adjustable deckle associated with the air distribution tube, the adjustable deckle configured to alter the flow of air through the air distribution tube, the second adjustable deckle comprising:

a second floating plate configured to selectively cover a second portion of the outer surface the air distribution tube; and a second deckle wall, wherein the second deckle wall is movable independent of the second floating plate.

5. The through-air apparatus of claim 4, wherein the second floating plate is selectively movable with the second deckle wall.

6. The through-air apparatus of claim 4, wherein the second adjustable deckle is positioned at the second end of the air distribution tube.

7. The through-air apparatus of claim 6, wherein the first and second adjustable deckles are both moveable together between a minimum deckle position and a maximum deckle position so that a distance between the first deckle wall and the second deckle wall can be determined based upon the width of a product to be positioned on the apparatus.

8. The through-air apparatus of claim 4, wherein the first floating plate and the second floating plate each further comprises a catch positioned at each end of the floating plates, wherein each catch on the first floating plate is configured to limit movement of the first deckle wall, and each catch on the second floating plate is configured to limit movement of the second deckle wall.

9. The through-air apparatus of claim 1, wherein the air distribution tube is concentric with the through air roll.

10. The through-air apparatus of claim 1, further comprising:

a pipe positioned along the first axis, and wherein the air distribution tube is supported radially by the pipe.

11. The through-air apparatus of claim 1, wherein the first floating plate has a cylindrical surface with a plurality of openings there through, and wherein the first floating plate is configured to alter the flow of air through the air distribution tube.

12. The through-air apparatus of claim 1, wherein the first floating plate has a cylindrical solid surface, and wherein the first floating plate is configured to reduce the flow of air through a first portion of the air distribution tube.

13. The through-air apparatus of claim 4, wherein the first floating plate and the second floating plate each have a cylindrical surface with a plurality of openings therethrough, and wherein the first floating plate and the second floating plate are configured to alter the flow of air through the air distribution tube.

14. The through-air apparatus of claim 4, wherein the first floating plate and the second floating plate each have a cylindrical solid surface, and wherein the first floating plate and the second floating plate are configured to reduce the flow of air through a first portion and a second portion of the air distribution tube.

15. A through-air apparatus for drying or bonding paper or non-woven products, the apparatus comprising:

a through air roll configured to rotate about a first axis, wherein the roll has a cylindrical surface, the cylindrical surface having a plurality of openings configured for the flow of air there through;

an air distribution tube positioned within the through air roll, the air distribution tube having an outer surface, a first end, and a second end, the outer surface of the air distribution tube having a plurality of openings configured for the flow of air there through;

a first adjustable deckle associated with the air distribution tube, the adjustable deckle configured to alter the flow of air through the air distribution tube, the first adjustable deckle comprising:

a first floating plate configured to selectively cover a first portion of the outer surface of the air distribution tube; and a first deckle wall, wherein the first deckle wall is movable independent of the first floating plate; and wherein the first adjustable deckle has a multi-plate configuration where the first floating plate includes a first floating plate portion and a second floating plate portion which are each movable and are configured to selectively cover a portion of the plurality of openings in the air distribution tube.

16. A through-air apparatus for drying or bonding paper or non-woven products, the apparatus comprising:

a through air roll configured to rotate about a first axis, wherein the roll has a cylindrical surface, the cylindrical surface having a plurality of openings configured for the flow of air there through;

an air distribution tube positioned within the through air roll, the air distribution tube having an outer surface, a first end, and a second end, the outer surface of the air distribution tube having a plurality of openings configured for the flow of air there through;

a first adjustable deckle associated with the air distribution tube, the adjustable deckle configured to alter the flow of air through the air distribution tube, the first adjustable deckle comprising:

a first floating plate configured to selectively cover a first portion of the outer surface the air distribution tube; and a first deckle wall, wherein the first deckle wall is movable independent of the first floating plate; and wherein the first floating plate of the first adjustable deckle further comprises a catch positioned at each end of the first floating plate, wherein each catch is configured to limit movement of the first deckle wall.

17. A method of using a through-air apparatus for drying or bonding paper or non-woven products, the method comprising:

providing a through air roll configured to rotate about a first axis, wherein the roll has a cylindrical surface having a plurality of openings configured for the flow of air there through;

providing an air distribution tube positioned within the through air roll, the air distribution tube having a first end, and a second end, and an outer surface having a plurality of openings configured for the flow of air there through; and moving a first floating plate of a first adjustable deckle relative to the air distribution tube to alter the flow of air through the air distribution tube, wherein the first floating plate is configured to selectively cover a first portion of the outer surface in the air distribution tube; and wherein movement of the first floating plate is initiated by movement of a first deckle wall of a first adjustable deckle, wherein the first deckle wall is movable independent of the first floating plate.

18. The method of claim 17, further comprising:

moving a second floating plate of a second adjustable deckle relative to the air distribution tube to alter the flow of air through the air distribution tube, wherein the second floating plate is configured to selectively cover a second portion of the plurality of openings in outer surface in the air distribution tube; and wherein movement of the second floating plate is initiated by movement of a second deckle wall of a second adjustable deckle, wherein the second deckle wall is movable independent of the second floating plate.

19. The method of claim 18, wherein the first and second adjustable deckles are both moveable between a minimum deckle position and a maximum deckle position so that a distance between the first deckle wall and the second deckle wall can be positioned based upon the width of a product to be positioned on the apparatus.

20. The method of claim 17, wherein the first floating plate is selectively movable with the first deckle wall.

* * * * *